US006223946B1

(12) United States Patent
Geisinger et al.

(10) Patent No.: US 6,223,946 B1
(45) **Date of Patent: *May 1, 2001**

(54) CLOSURE FOR CONTAINER AND CLOSURE PACKAGE AND METHOD OF MAKING SAME

(75) Inventors: Gregory A. Geisinger, Toledo; George R. Trepina, Holland; Eugene F. Haffner, Waterville; Mark R. Kidd, Haskins, all of OH (US)

(73) Assignee: Owens Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/488,291

(22) Filed: Jan. 20, 2000

Related U.S. Application Data

(62) Division of application No. 09/082,478, filed on May 21, 1998, now Pat. No. 6,032,829.

(51) Int. Cl.[7] ..... B67D 1/16

(52) U.S. Cl. ..... 222/111; 222/552

(58) Field of Search ..... 222/109, 111, 222/551, 552, 562, 566; 215/211, 216, 217, 220, 352, 354, 356

(56) References Cited

U.S. PATENT DOCUMENTS

| | | | | |
|---|---|---|---|---|
| 3,000,525 | | 9/1961 | Leslie-Smith . | |
| 3,089,603 | | 5/1963 | Leslie-Smith . | |
| 3,281,002 | | 10/1966 | Geiss . | |
| 3,380,610 | | 4/1968 | Krieps . | |
| 3,822,027 | | 7/1974 | Cherba . | |
| 4,004,704 | | 1/1977 | Hilaire . | |
| 4,117,945 | | 10/1978 | Mumford . | |
| 4,393,976 | | 7/1983 | Maguire . | |
| 4,640,855 | * | 2/1987 | St. Clair | 215/356 |
| 4,917,269 | | 4/1990 | Fuchs et al. . | |
| 5,020,692 | * | 6/1991 | Darr | 222/109 |

(List continued on next page.)

*Primary Examiner*—Philippe Derakshani
*Assistant Examiner*—Thach H Bui

(57) ABSTRACT

A closure for a container-and-closure sealing system embodied in a container and closure package, and method of making the same. The container has an open mouth surrounded by a cylindrical neck wall having internal threads and an open upper edge. The closure is a cap/dispensing cup type and has a skirt with external threads adapted for threaded receipt within the container neck wall. A circumferentially continuous flange projects outwardly from the skirt and has a conical portion adapted for cam engaging, trapping and sealing with the open upper edge of the neck wall as the closure is threaded into this wall. The closure skirt also has a circumferentially continuous plug-type sealing surface that extends radially outwardly from the skirt between the trapping flange and closure external threads adapted for interference sealing engagement with the neck wall as the closure is threaded thereinto. The materials of the closure and container may differ in hardness relative to another so that either the plug seal rib of the juxtaposed neck wall surface deforms under closure/container engaging forces to thereby enhance the sealing capability and life. The flange has a conical skirt wall portion integrally dependent from a flange radial wall portion that is adapted to sealing cam wedge embrace the neck open upper edge and creates increasing squeeze force as the closure is threaded into the neck wall. A concentrically intermediate annular seal is also provided in the form of V-rib or liner material interposed in assembly between the container upper edge and the flange radial wall portion. The container neck wall may have a circumferentially continuous internal groove disposed between the neck internal threads and open upper edge for receiving the closure plug seal rub by interference snap fit when the closure is threaded into the wall and reaches closed position thereon to thereby enhance removal torque capability.

27 Claims, 3 Drawing Sheets

U.S. PATENT DOCUMENTS 5,078,288 * 1/1992 Fuchs ..... 222/566
5,114,659 5/1992 Krall .
5,207,341 5/1993 Yeager .
5,207,356 5/1993 Krall .
5,297,688 3/1994 Beck et al. .
5,833,928 * 11/1998 Ratajczak ..... 215/332

* cited by examiner

CLOSURE FOR CONTAINER AND CLOSURE PACKAGE AND METHOD OF MAKING SAME

This Application is a division of 09/082,478 May 21, 1998, now U.S. Pat. No. 6,032,829.

FIELD OF THE INVENTION

This invention relates to liquid containing and dispensing packages, and more particularly to DBS container-and-closure packages which include a pouring spout and a removable closure that also functions as a measuring cup.

BACKGROUND OF THE INVENTION

In one widely-used commercial type of liquid containing and dispensing package incorporating a drainback system (DBS), a pouring spout is positioned on the neck of the container, either as part of a drip-catching apron fitment or integrally molded with the container body, and a closure in the form of a combined cap and dispensing cup is removably threadably interengaged with the periphery of the container neck or spout fitment.

For example, Krall U.S. Pat. No. 5,207,356 (incorporated herein reference) shows a plastic liquid containing and dispensing package which comprises a plastic blow molded container having a body portion which terminates at its upper end in an integrally formed dispensing portion that extends from and communicates with the body portion. The dispensing portion includes an annular wall or collar which extends around the body opening and encircles a dispensing spout connected at its lower end to the surrounding collar by a integral web portion that forms the drainback channel and catch apron. The interior surface of the collar has internal threads that cooperate with external threads on a closure in the form of a combined cap and dispensing cup. The closure includes a top wall and a depending annular sidewall skirt that has a sealing ring extending radially outwardly therefrom above the external threads on the skirt. When the cap is screwed down to closed position on the container neck collar, the sealing ring of the cap engages the upper end edge of the collar to provide a seal against leakage of the contents from the container.

Other types of removable closure seals are also typically provided with such container closures. For example, Hilaire U.S. Pat. No. 4,004,704 shows a tamper-proof plastic closure provided with an internal slirt forming a plug-type seal with the inner surface of the container neck as well as a V-shaped annular rib engaged in the upper end edge of the container neck to form a second seal. Likewise, Mumford U.S. Pat. No. 4,117,945 shows another type of child resistant safety closure in which sealing of the closure with the upper end of the container may be effected by a multiple sealing system including, in various disclosed embodiments, a resilient, fluid-impermeable sealing liner provided on the underside surface of the end wall of the closure, a continuous annular sealing rib of flexible and resilient material that engages the exterior cylindrical surface of the container neck as well as a sealing plug of resilient material that engages the internal surface of the container neck.

With such prior art DBS containers with cup/cap closures or with such child resistant safety closures, low viscosity products and pressure building products packaged in the container have the potential to leak past such sealing systems due to a number of factors. In the case of a plug-type seal on the closure, using a plastic container having an internal thread cooperating with an external thread on the plastic closure has in the past led to poor strip torque capability and leakage over time due to material creep. Providing an interference fit of the plug seal of the closure tends to push the container neck wall away from the plug, thereby reducing the effectiveness of the seal. Also, use of a plug-type seal in of itself may not provide sufficient torsional resistance in the fully closed and sealed position of the closure on the container to prevent the closure thread from stripping past the container thread under excessive, but often typical, hand applied final closure tightening force. However, plug-type seals are advantageous in that they can be used to help re-form an out-of-round container neck to a more true round condition to thereby improve centering of other concentric seals when a multiple array sealing system is provided between the closure and container.

OBJECTS OF THE INVENTION

Accordingly, among the objectives of the present invention are to provide an improved liquid containing and dispensing package of the type employing a plug seal in a closure-and-container system, and of the type in which the closure has an externally threaded skirt received within an internally threaded container neck or finish, and wherein (1) the closure and container neck are constructed to create a plug seal fit with enough interference to create a positive seal and withstand the normally applied torque without stripping of the closure/container thread system, (2) sealing engagement force is directly proportional to screw-down force applied to the closure in reaching closed position on the container, (3) the closure seals and container cooperate to improve the centering of a multiple concentric array sealing system, (4) improved correction of any out-of-round condition of the container is effected during seal closure application, (5) the closure construction is readily adaptable to provision of multiple sequential seals of the liner type or V-ring type, final closure screw-down increases the torque required to cause the closure thread to strip past the container thread to thereby achieve high torque capability without danger of thread stripping, and improved removal torque capability is also achieved.

A further object is to provide an improved method of forming an improved plug seal between a plastic container and a plastic closure that is capable of achieving the aforementioned objectives while utilizing economical, mass production plastic molding techniques and equipment already available and that is readily adaptable to manufacture of a variety of closure-and-container systems utilizing plug-type seals.

SUMMARY OF THE INVENTION

In general, and by way of summary description and not by way of limitation, the invention accomplishes the foregoing as well as additional objects set forth hereinafter by providing an improved closure for a container-and-closure sealing system embodied in a container and closure package, and an improved method of making the same, wherein the container has an open mouth surrounded by a cylindrical neck wall having internal threads and an open upper edge. The closure is preferably of the cap-and-dispensing cup type and has a skirt with external threads for threaded receipt within the container neck wall. A circumferentially continuous flange projects outwardly from the skirt that is constructed and arranged with a conical portion for cam engaging, trapping and sealing with the open upper edge of the neck wall as the closure is threaded into this wall. The closure skirt also has a circumferentially continuous plug-type sealing surface that extends radially outwardly from the skirt between the trapping flange and closure external threads for interference sealing engagement with the neck wall as the closure is threaded thereinto.

At least one of the container and closure components is made of resiliently deformable plastic material, and preferably both the closure and container are made of plastic material, and the materials of the closure and container preferably differ in hardness relative to another, so that either the plug seal rib or the juxtaposed neck wall surface defonns under closure/container engaging forces to thereby enhance the sealing capability and life.

Preferably, the closure is injection molded in one piece from plastic material so that the trapping flange comprises an annular innermost wall portion integrally joined to the closure skirt that protrudes radially outwardly and also is inclined upwardly (in the container package storage orientation) and thus away from said closure threads. The trapping flange also is formed with a radially outwardly extending wall portion integrally joined with the flange inner wall portion that radially overlaps the container neck open upper edge in assembly. The flange conical portion is formed by a conical skirt wall portion integrally dependent from the radial wall portion that sealing cam wedge embraces the neck open upper edge and creates increasing squeeze force as the closure is threaded into the neck wall. Preferably the plug seal rib is integrally formed on the flange inner wall portion.

A concentrically intermediate annular seal can be provided in the form of V-rib or liner material interposed between the container upper edge and the flange radial wall portion.

In one embodiment, the container neck wall is provided with a circumferentially continuous internal groove disposed between the neck internal threads and neck open upper edge for receiving the closure plug seal rib by interference snap fit when said closure is threaded into the wall and reaches closed position thereon to thereby enhance removal torque capability.

BRIEF DESCRIPTION OF THE DRAWINGS

The foregoing as well as other objects, features and advantages of the present invention will become apparent from the following detailed description of the best mode presently known to the inventors of making and using the invention, from the appended claims and from the accompanying drawings (which are to engineering scale unless otherwise indicated) wherein:

DETAILED DESCRIPTION OF THE FIRST EMBODIMENT

Figure 1:
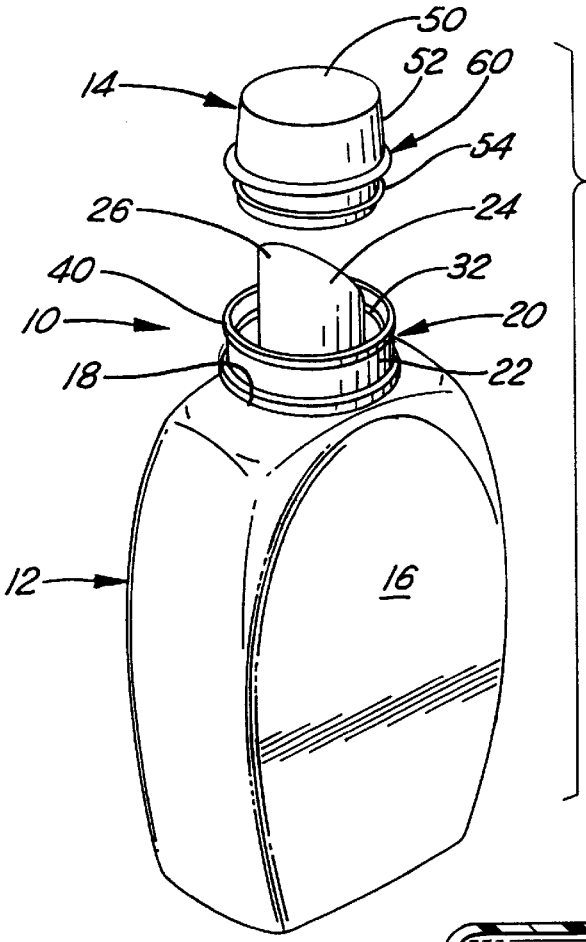
FIG. 1 is a perspective view showing an exemplary but preferred form of container constructed in accordance with the present invention and an associated closure in the form of a combined cap and dispensing cup, shown positioned above the container, and also constructed in accordance with the invention to together provide a sealed liquid containing and dispensing package.
Figure 3:
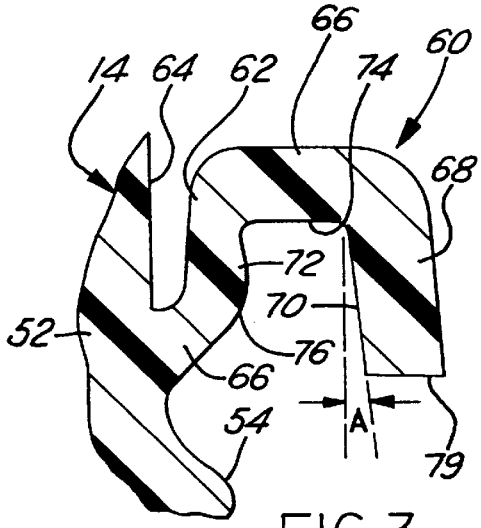
FIG. 3 is a fragmentary view of the portion of FIG.2 encompassed by the circle 3 in FIG. 2 and greatly enlarged thereover.

In accordance with the first embodiment of the invention shown in FIGS. 1–4, a closure-and-container package 10 is shown in FIG. 1 that, by way of example, is of the self-draining DBS type that comprises a plastic bottle 12 specifically designed for liquids and which may be constructed in accordance with the disclosure of the aforementioned Krall U.S. Pat. No. 5,207,356. The package also includes a removable combination cap and dispensing cup type closure 14 designed for removable threaded attachment to container 12.

Container 12 includes a hollow body portion 16 which terminates at its upper end in an opening 18 through which the contents of the container 12 can be dispensed. A dispensing portion 20 extends from and communicates with body portion 16 and includes a circular cylindrical wall or collar 22 which extends angularly around body opening 18. A dispensing spout 24 is located within and is encircled by collar 22 and includes an upper end pouring lip 26 which extends above the uppermost free end edge 28 of collar 22. Dispensing portion 20 may be of separate components joined together, or integrally formed. (As used herein, the term "integral" means a one-piece construction as molded, as distinguished from multiple pieces joined together.)

A connecting web 30 extends between spout 24 and collar 22, where the web 30 and collar 22 are integrally joined with body 16, and is also integrally joined with the lower edge of spout 24. Web 30 thus interconnects neck wall 22 and dispensing spout 24 and cooperates therewith to define a drip-catching apron and drain trough channel into which spillage liquid flowing from exterior of dispensing spout 24 will drain when container 12 is uprighted after it has been inverted for pouring. Preferably, web 30 extends at least half way around spout 24 to prevent flow of liquid into the apron channel when container 12 is partially inverted to a pouring position.

Figure 4A:
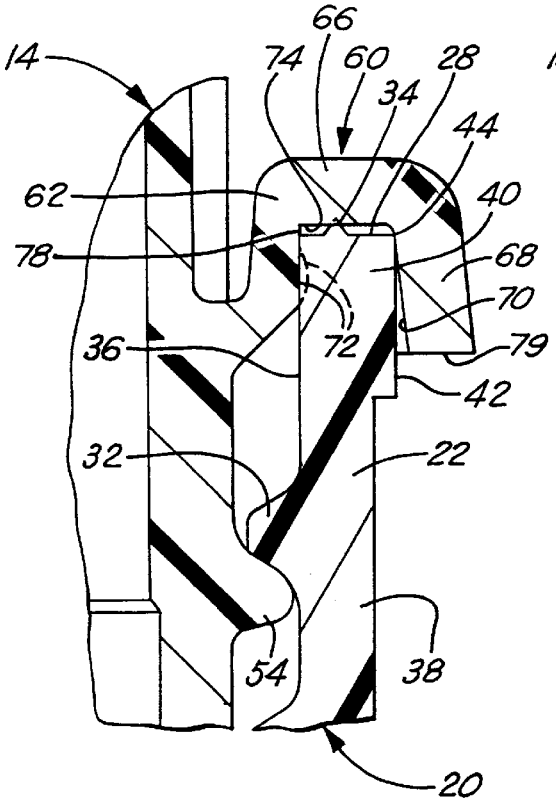
FIG. 4A is a view similar to FIG. 4 but illustrating a modification of the first embodiment.
Figure 4:
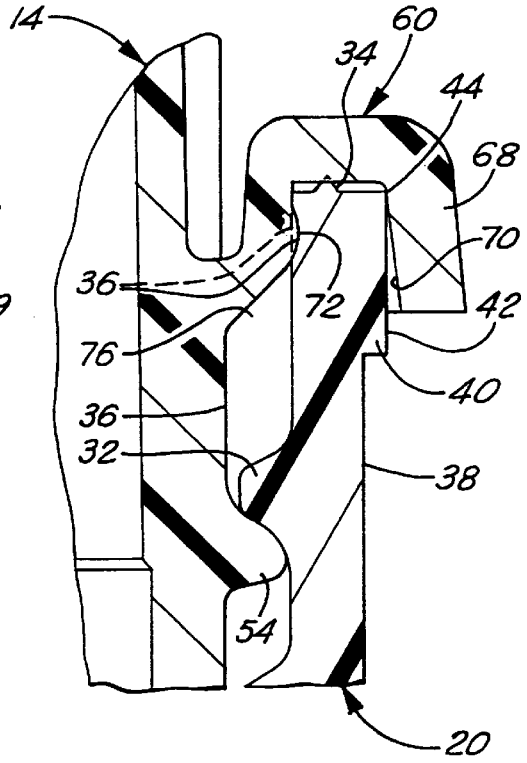
FIG. 4 is a fragmentary enlarged center sectional view of the first embodiment of the cap and container in fully closed and sealed condition.
Figure 5:
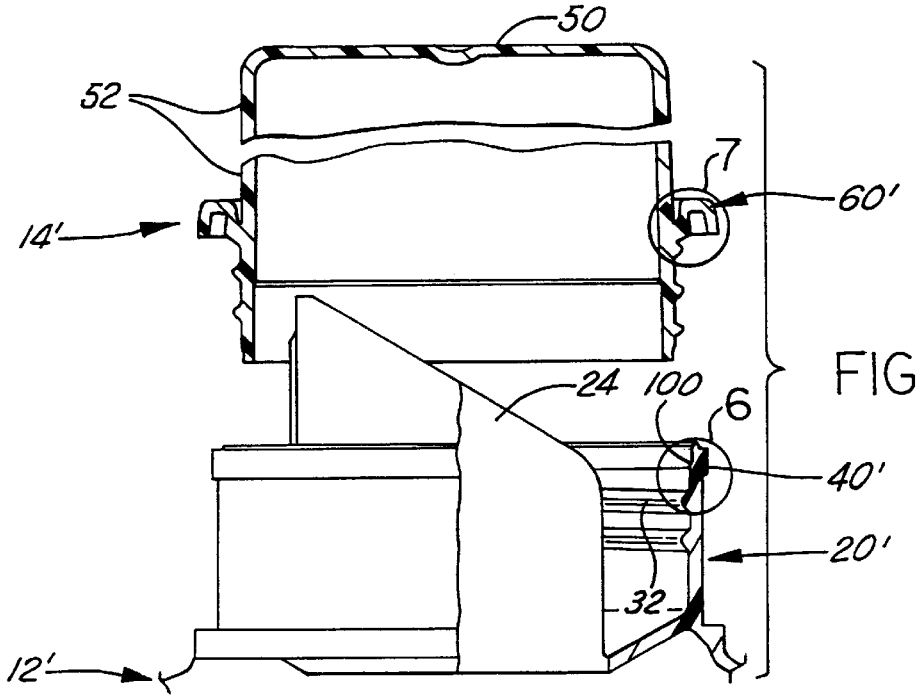
FIG. 5 is a fragmentary center sectional view corresponding to that of FIG. 2 but illustrating a second embodiment of the closure-and-container system of the invention.
Figure 6:
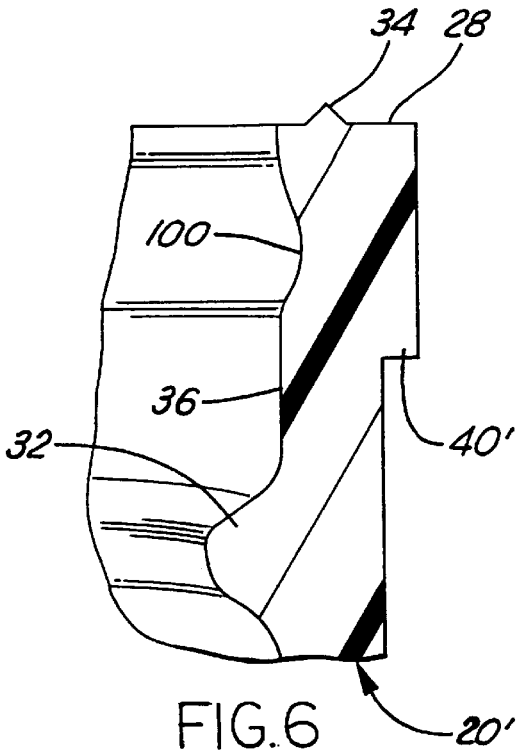
FIG. 6 is a view of the portion of FIG. 5 encompassed by the circle 6 in FIG. 5 and greatly enlarged thereover.
Figure 7:
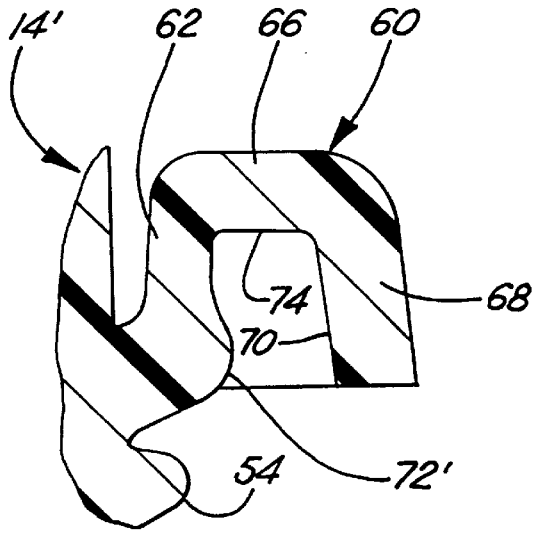
FIG. 7 is a view of the portion of FIG. 5 encompassed by the circle 7 in FIG. 5 and greatly enlarged thereover.
Figure 8:
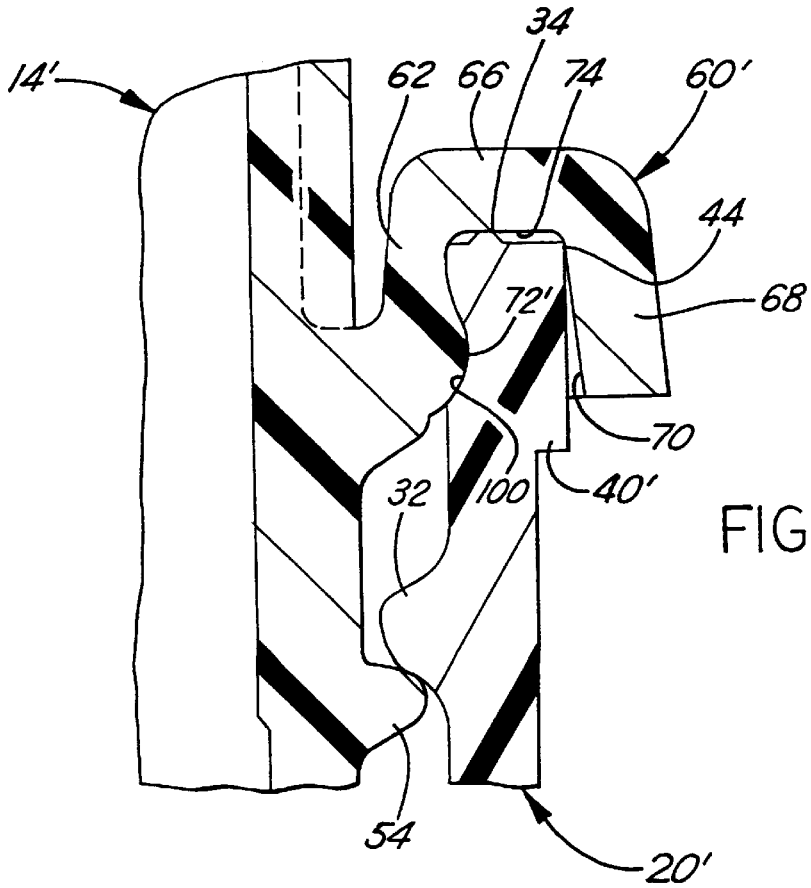
FIG. 8 is a fragmentary view of the second embodiment closure and container finish assembled together in fully closed and sealed condition.

The interior surface of wall 22 is provided with internal threads 32 which may have the thread profile form shown in cross section in FIG. 4. The upper free end edge 28 of container neck wall 22 is preferably provided with a circumferentially continuous sealing rib 34 of the type having an inverted V-shape in radial cross section and disposed generally centrally of the radial dimension of the wall. Alternatively, V-seal bead 34 may be formed on the underside of flange 60 to seal against a flat upper surface of wall 22. The interior surface 36 of wall 22 in the zone extending from upper edge 28 down to the uppermost reach of thread 32 is preferably cylindrical in shape in this embodiment. Preferably, the uppermost portion of neck wall 22 has an outside diameter greater than that of the major outside surface 38 of wall 22 to thereby form a radially thickened head portion 40 having a cylindrical outer surface 42 that intersects collar end surface 28 at a right angle annular comer junction 44.

Figure 2:
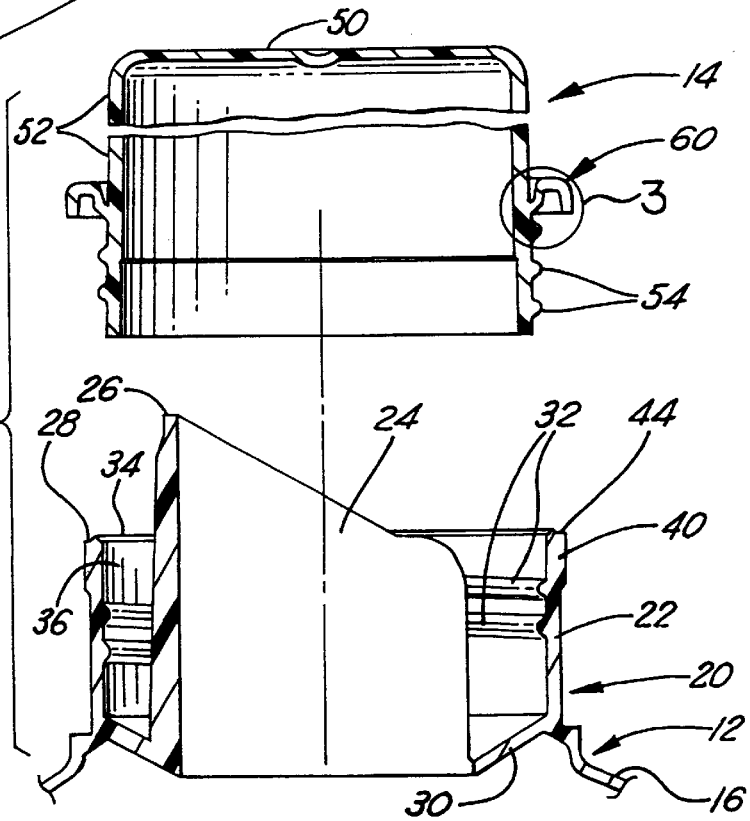
FIG. 2 is an exploded, fragmentary center sectional view taken along the longitudinal axes of the container and closure with these parts positioned as in FIG. 1.

Closure 14 is in the form of a closure cap for container 12 when inverted as shown in FIGS. 1 and 2 and sealingly attached to container 12, and which when removed from the container and inverted serves as a dispensing cup for the container contents poured thereinto. Closure 14 thus has a closed, flat end wall 50 and a slightly frusto-conical annular skirt wall 52 dependent from end wall 50. Both walls 50 and 52 are imperforate and impermeable to the contents contained in container 12. The lower portion of the outer periphery of skirt wall 52 is provided with a continuous multi-turn thread 54 adapted to cooperate with the multi-turn threads 32 of container 12 for threadably attaching and detaching closure 14 on container 12 in the usual manner. Thread 54 may have the thread profile form best seen in enlarged scale in FIG. 4.

In accordance with a principal feature of the present invention, an improved form of flange-type sealing ring 60 extends radially outwardly from skirt wall 52 so as to encircle the sane as a circumferentially continuous annulus and is disposed at a predetermined design axial elevation above and relative to threads 54. Sealing ring 60 preferably has a generally inverted U-shape in radial cross section (FIG. 3) as defined by: (1) an annular radially inner wall portion 62 that extends slightly divergently from the adjacent surface 64 of skirt wall 52 and joined thereto by a connecting portion 66; (2) a generally flat, radially outwardly extending wall portion 66 which is integrally joined radially at its innermost edge to wall portion 62; and (3) a dependent camming wall portion 68 having a smooth frusto-conical interior calming surface 70 inclined at angle A (preferably about 7°) to the axis of closure 14. Preferably, the radially outermost surface of flange inner wall portion 62 is provided with an annular circumferentially continuous sealing rib portion 72 spaced axially downwardly a predetermined distance from the flat undersurface 74 of flange wall portion 66.

Preferably, in the first form of package 10 constructed pursuant to FIGS. 1–4, closure 14 is injection molded of a suitable plastic material such as polypropylene or polypropylene copolymer, having a typical hardness on the Shore D scale of 70 to 75, whereas container 12 is constructed in accordance with the disclosure of the aforementioned U.S. Pat. No. 5,207,356 of plastic material such as high density polyethylene, having a hardness on the Shore D scale of, for example, 60 to 65. Hence, in this form, the material of the closed flange 60 is considerably harder than that of head 40 of container neck 20.

To assemble closure 14 onto container 12 to form a closed and sealed package 10, the closure is inserted open-end first into container neck 20 and manually rotated to start closure threads 54 into threaded engagement with neck threads 32. As closure 14 is thus screwed down into container neck 22, an inclined annular surface 76 (FIG. 3) forming the leading or lower edge of plug seal rib 72 will come into sliding and outwardly canming contact with the annular inner upper edge 78 of neck head 40 (FIG. 4). This occurs shortly after the initial downward axial travel of the closure has carried the lower free edge 79 of inclined flange skirt wall 68 past the outer upper edge 44 of head 40 while being spaced radially outwardly therefrom. Thus, flange 60 will have "trapped", by way of encirclement by flange skirt 68, the upper edge of the container finish head 40 prior to engagement of rib 72 therewith.

As best seen in FIG. 4, the spacing dimension radially of flange 60 between the peak of rib 72 in its free state condition and the radially juxtaposed surface region of the inclined surface 70 of flange skirt 68 is made smaller by a predetermined amount than the radial thickness dimension of head 40 between its inner and outer surfaces 36 and 42. Hence, as flange 60 is drawn progressively down onto head 40 by continued screw-down rotation of closure 14, plug seal rib 72 will tend to radially outwardly deform head 40, but such head-bulging action will be restrained as head edge 44 engages the lower portion of skirt surface 70. Then as screw-down travel continues, the material of rib 72 will be compressed by the wedge camming action of inclined surface 70 slidably engaging the outer edge 44 of head 40.

When closure 14 has been screwed down sufficiently on container neck 20 to bring flange 60 to its fully closed and sealed position on the container, i.e., that shown in FIG. 4, the V-seal rib 34 will have engaged and been pressed into undersurface 74 of flange leg 66, while the plug seal rib 72 will deform the softer material of head 40 from its original shape (shown in broken lines in FIG. 4) to a flattened deformed engagement position (shown in solid lines in FIG. 4). Meanwhile, the tapered flange skirt surface 70 will have been forced to slide down past the upper outer edge 44 of head 40 thereby gradually tightening the interference trapping wedge fit of flange 60 on the upper end of container neck 22.

It is to be noted that, as this progressively increasing interference fit is occurring during final rotational screw-down of closure 14 onto container neck 20, the amount of torque required to rotate closure 14 rapidly increases due to the frictional torsional resistance generated by this trapped camming wedge engagement of flange 60 with the upper end of container neck 20. This "end limit" torsional frctional resistance to relative rotation of closure 14 and container 12 is additive to that generated between threads 32 and 54 when closure 14 has "bottomed" on container neck 22, and thus normally exceeds the force that can be generated by manual application of rotational torque on closure 14 sufficient to cause stripping of threads 32 and 54 relative to one another.

Once closure 14 has been screwed down sufficiently to fully seat head 40 into trapped relation in flange 60, as described hereinabove, it will be seen that three annular concentric sealing zones have been formed in series between the interior of container 12 and the potential outlet to ambient defined between head surface 42 and the lower region of inclined surface 70 of skirt wall 68. A first and primary seal is formed between the plug seal interference fit of plug seal rib 72 with neck surface 36. A second sealing zone is formed by the engagement of the V-seal 34 with the undersurface 74 of flange wall portion 66. The third sealing zone occurs between the upper outer edge 44 of container neck 20 and the upper region of surface 70 of flange skirt 68. It thus will be seen that the improved closure-and-container sealing system of the invention has improved capability to prevent leakage of low viscosity products and/or pressure building products. This results from the tendency of plug seal rib 72 to expand head 40 by its engagement therewith during screw down of closure 40 being opposed by the trapping and inward camming action of flange skirt 68 that progressively increases due to the inclination of flange surface 70.

In addition, it is to be noted that the trapping action of skirt wall 68, in cooperation with the engagement of seal rib 72 with the neck interior surface 36 also improves the centering of the seal system by forcing closure 14 to align its axis with that of the container. Moreover, the plug seal rib 72, with its lead-in tapered wall 76, will also tend to flex container neck 20 sufficiently to overcome any out-of-round condition in the same so as to thereby improve the sealing engagement in each of the three aforementioned annular sealing zones.

It will also be understood that the dimensional relationship of flange 60 relative to head 40 is designed to leave a clearance space between flange undersurface 74 and the upper surface 28 of head 40, thereby providing a cavity to install a suitable sealing liner material ring, if desired, (not shown), as an alternative to the V ring seal 34 to further improve the sealing potential of the system of the invention.

FIG. 4A illustrates a modification of the closure-and-container sealing system of FIGS. 1–4 wherein the material of closure 14 is suitably selected to have a durometer hardness lower than that of the material utilized in formation of container neck 20. Thus, instead of the material of head 40 deforming rib 72 from its free state, radially outwardly bulging shape, to the flattened pressed shape of FIG. 4, the opposite effect occurs. That is, seal plug rib 72 is substantially deformed by the interference engagement with head 40 during closure screw-down tightening and the opposing neck surface 36 is undeformed. Although not illustrated in FIG. 4A, the upper outer edge 44 of head 40 in this modification will likewise be slightly deformed and rounded to thereby increase the sealing surface area in sealing engagement in this third sealing zone due to head 40 being formed of the softer of the two materials. Thus, it will be seen that the closure sealing system of the invention is adaptable for use with a variety of diverse selections of material for closure 14, on the one hand, and that of container 12 on the other, even including glass and plastic combinations or metal and plastic combinations. V-seal ring 34 again may be on wall 22 as shown, or on closure flange 60.

DETAILED DESCRIPTION OF THE SECOND EMBODIMENT

FIGS. 5–8 illustrate a second embodiment of the closure-and-container sealing system of the invention wherein like elements are given like reference numerals and their description not repeated, and those elements alike in fimction are given the same reference numerals raised by a prime suffix. In this embodiment, the finish of the container is provided with an annular circumferentially continuous internal groove 100, best seen in FIG. 6, at a predetermined design location in interior surface 36 axially between the uppermost tum of thread 32 and the upper end surface 28 of head 40. Closure 14' is identical to closure 40 except that the trapping flange 60' is provided with the circular sealing plug rib 72' having a suitably modified contour, and being made of a deformable material with sufficient resilience to be resiliently yieldably deformed during downward travel of flange 60' relative to head 40' to enable it to be squeezed radially inwardly by the material of head 40' until rib 72' registers with groove 100, whereupon rib 72' can snap into the groove due to its resilience as closure 14' becomes fully seated on container finish 20' . Again, the wedging engagement of the trapping flange 60' with head 40' of the container finish fimctions in the manner previously described to effect three-zone sealing, centering of the closure on the container finish, reforming the container finish and/or closure to mating round concentricity, from out-of-round condition of either as made, to thereby insure proper centering of the sealing surfaces relative to one another, and prevents the container finish from spreading apart, thus inhibiting thread stripping.

In addition, the snap-in engagement of rib plug seal 72' with groove 100 requires a higher initial torque application to initiate retrograde relative rotation for unscrewing of closure 14' from container 12 to thereby enhance removal torque capability of the sealing system.

From the foregoing description, it will now be apparent to those skilled in the art that the closure-and-container sealing system of the invention provides an improved liquid containing and dispensing package and method of making the same in accordance with the invention that amply fulfills the aforestated objects and provides many advantages and features over the prior art. A provision of a closed flange on the closure traps the upper edge of the container finish to assist in initial self-centering of the two components and urges the container finish into interference plug fit with the opposing surface of the closure. Such trapping engagement eliminates the loss of sealing finction due to material creep with age, and also provides improved torque retention and strip torque capabilities. The second embodiment provides even further enhanced removal torque capability. The system is adaptable to a diverse selection of materials between those of the closure and container and hence is suitable for a wide variety of applications, although particularly well suited to liquid containing and dispensing packages of the type disclosed by way of preferred examples herein.

What is claimed is:

1. A closure for use with a container and closure package wherein the container has an open mouth surrounded by a cyndrical wall having internal threads and an open upper edge, said closure having a skirt with external threads adapted for threaded receipt within the container cylindrical wall, a circumferentially extending flange projecting outwardly from said skirt and having a tapered skirt wall portion constructed and adapted for progressively cam engaging and trapping the open upper edge, of the container cylindrical wall as said closure is threaded into the wall, and a circumferenfially continuous sealing surface provided on said skirt between said flange and said external threads, adapted for interference sealing engagement with an interior surface of the container cylindrical wall.as said closure is threaded into the wall, at least one of the container and said closure being made of resiliently deformable plastic material.

2. The closure set forth in claim 1 wherein said flange skirt wall portion comprises a circumferentially continuous frustoconical closed flange surface.

3. The closure set forth in claim 1 wherein said circumferentially continuous sealing surface on said closure skirt comprises a circumferentially continuous rib extending a radially outwardly from said skirt between said flange and said extenal threads.

4. The closure set forth in claim 3 wherein the container wall also has an internal circumferential continuous channel disposed between the container internal threads and the container open upper edge, said closure sealing surface being constructed for engaging the container channel by interference snap fit when said closure is threaded into the container wall.

5. The closure set forth in claim 1 wherein said closure and the container are both made of plastic material.

6. The closure set forth in claim 5 wherein the plastic materials of said closure and the container differ in hardness relative to another.

7. The closure set forth in claim 1 wherein said skirt flange comprises an annular inner wall portion integral with said skirt and protruding radially outwardly, and inclined away from said closure threads, a radially outwardly extending wall portion integrally joined with said inner wall portion and adapted to radially overlap the container open upper edge in assembly, said skirt wall portion being integrally dependent from said radial wall portion constructed and adapted to sealing embrace said container open upper edge as said closure is threaded into the container wall.

8. The closure set forth in claim 7 wherein said closure sealing surface comprises a radially outwardly protruding circular plug seal rib on said flange inner wall portion.

9. The closure set forth in claim 8 wherein said skirt wall portion has a camming surface tapered to produce an increasing interference fit between said flange inner wall and skirt wall portions as said closure is threaded into the container wall;

10. The closure set forth in claim 9 wherein sealing means is interposed between the container upper edge and said flange radial wall portion.

11. The closure set forth in claim 5 wherein the container wall has an internal circumferentially continuous internal groove disposed between the container internal threads and the container open upper edge for receiving said closure rib by interference snap fit when said closure is threaded into the container wall and reaches closed position thereon.

12. A method of forming a plug seal between a plastic container and a plastic closure wherein the container has an open mouth surrounded by a cylindrical wall with internal threads and an open upper edge, said method comprising the steps of:

(a) forming on the closure a cylindrical skirt with external threads for threaded receipt into the container cylindrical wall, a circumferentially continuous closed flange projecting outwardly from the skirt; and a circumferentially continuous rib extending radially outwardly from said skirt between said external threads and said flange, and (b) threading said closure into the container wall until said closed flange captures the container upper edge and urges the container upper edge radially inwardly into interference sealing engagement with said rib.

13. The method set forth in claim 12, wherein the container also has an inwardly opening circumferentially continuous channel on the container wall between the container internal threads and container upper edge, and wherein said step (b) further comprises the step of threading said closure into the container wall until said rib is received by interference snap fit into the container channel.

14. A closure for use with a container and closure package wherein the container has an open mouth surrounded by a cylindrical wall having internal threads and an open upper edge, said closure having a skirt with external threads adapted for threaded receipt within the container cylindrical wall, a circumferentially continuous flange projecting outwardly from said skirt and having a skirt wall portion adapted for engaging and trapping the open upper edge of the container cylindrical wall as said closure is threaded into the container wall, and a circumferentially continuous sealing surface provided on said skirt between said flange and said external threads adapted for interference sealing engagement with an interior surface of the container wall as said closure is threaded into the container wall at least one of the container and said closure being made of resiliently deformable plastic material, wherein the container wall has an internal circumferentially continuous channel disposed between the container internal threads and the container open upper edge for engaging said sealing surface on said closure by interference snap fit when said closure is threaded into said wall.

15. The closure set forth in claim 14 wherein said flange comprises an annular inner wall portion integral with said skirt and protruding radially outwardly and inclined away from said closure thread, a radially outwardly extending wall portion integrally joined with said inner wall portion and adapted to radially overlap the container open upper edge in assembly, said skirt wall portion being integrally dependent from said radial wall portion constructed and arranged to sealing embrace the container open upper edge as said closure is threaded into the container wall.

16. The closure set forth in claim 16 wherein said closure sealing surface comprises a radially outwardly protruding circular plug seal rib on said flange inner wall portion.

17. The closure set forth in claim 16, wherein said skirt wall portion has a camming surface tapered to produce an increasing interference fit between said flange inner wall and skirt wall portions as said closure is threaded into the container wall.

18. The closure set forth in claim 17 wherein sealing means is interposed between the container upper edge and said flange radial wall portion.

19. The closure set forth in claim 14 wherein the container wall has an internal circumferentially continuous internal groove disposing between the container internal threads and the container open upper edge for receiving said closure rib by interference snap fit wherein said closure is threaded into the container wall and reaches closed position thereon.

20. A closure for a container of a container and closure package, said closure comprising an end wall and a skirt dependent therefrom and having a circumferentially extending flange projecting outwardly from said skirt and having a tapered skirt wall portion and a circumferentially continuous sealing surface provided on said skrt between said flange and said external threads.

21. The closure set forth in claim 20 wherein said flange skirt wall portion comprises a circumferential continuous fiustoconical closed flange surface.

22. The closure set forth in claim 20 wherein said circumferentially continuous sealing surface on said closure skirt comprises a circumferentially continuous rib extending a radially outwardly from said skirt between said flange and said external threads.

23. The closure set forth in claim 20, wherein said closure and the container are both made of plastic material.

24. The closure set forth in claim 20 wherein the plastic materials of said closure and the container differ in hardness relating to another.

25. The closure set forth in claim 20 wherein said flange comprises an annular inner wall portion integral with said skirt and protruding radially outwardly and inclined away from aid closure threads, a radial outwardly extending wall potion integrally joined with said inner wall portion and a skirt wall portion integrally dependent from said radially wall portion.

26. The closure set forth in claim 25 wherein said closure sealing surface comprises a radially outwardly protruding circular plug seal rib on said flange inner wall portion.

27. The closure set forth in claim 26 wherein said skirt wall portion has a camming surface tapered to produce an increasing interference fir of the container open upper edge between said flange inner wall and skirt wall portions.

* * * * *